US006641184B2

(12) United States Patent
Erices et al.

(10) Patent No.: US 6,641,184 B2
(45) **Date of Patent: *Nov. 4, 2003**

(54) MOTOR VEHICLE ELECTRIC DOOR LOCK AND A PROCESS FOR INSTALLING A MOTOR VEHICLE DOOR LOCK MADE AS AN ELECTRIC LOCK

(75) Inventors: Bernardo Erices, Galdbach (DE); Simon Brose, Hattingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/032,695

(22) Filed: Jan. 2, 2002

(65) Prior Publication Data

US 2002/0167176 A1 Nov. 14, 2002

(30) Foreign Application Priority Data

Jan. 2, 2001 (DE) ..... 101 00 010

(51) Int. Cl.[7] ..... E05C 3/06; E05C 3/16

(52) U.S. Cl. ..... 292/216; 292/215; 292/201; 292/197; 292/DIG. 23

(58) Field of Search ..... 292/216, 215, 292/201, 197, DIG. 23

(56) References Cited

U.S. PATENT DOCUMENTS

| | | | | | |
|---|---|---|---|---|---|
| 3,620,560 | A | * | 11/1971 | Peters | 292/201 |
| 3,785,186 | A | * | 1/1974 | James et al. | 70/240 |
| 4,363,231 | A | * | 12/1982 | Kaveney, Jr. | 70/484 |
| 4,904,006 | A | * | 2/1990 | Hayakawa et al. | 292/336.3 |
| 5,000,495 | A | * | 3/1991 | Wolfgang et al. | 292/216 |
| 5,020,838 | A | * | 6/1991 | Fukumoto | 292/201 |
| 5,066,054 | A | * | 11/1991 | Ingenhoven | 292/201 |
| 5,308,128 | A | * | 5/1994 | Portelli et al. | 292/216 |
| 5,308,129 | A | * | 5/1994 | Hlavaty | 292/216 |
| 5,348,357 | A | * | 9/1994 | Konchan et al. | 292/216 |
| 5,632,515 | A | * | 5/1997 | Dowling | 292/216 |
| 5,802,894 | A | * | 9/1998 | Jahrsetz et al. | 70/264 |
| 5,847,519 | A | * | 12/1998 | Kilker | 292/216 |

(List continued on next page.)

FOREIGN PATENT DOCUMENTS

| | | | | |
|---|---|---|---|---|
| DE | 195 45 722 A1 | | 4/1997 | |
| EP | 0 589 158 A1 | | 3/1994 | |
| FR | 2775016 A1 | * | 8/1999 | ..... E05B/65/12 |

*Primary Examiner*—Robert J. Sandy
*Assistant Examiner*—Matthew E. Rodgers
(74) *Attorney, Agent, or Firm*—Nixon Peabody LLP; David S. Safran

(57) ABSTRACT

A motor vehicle electric door lock with an outside housing which is essentially closed on all sides, with an inlet channel for the key collar and with, located in the outside housing, a rotary latch, a detent pawl which holds the rotary latch, a separate detent pawl lever which is dynamically connected to the detent pawl or which is made on the detent pawl as an extension, and an electrical opening drive unit with a drive motor, step-down gearing, and a driven element, the driven element via the detent pawl lever driving the detent pawl in the lifting direction and engaging the actuating section of the detent pawl lever.

The outside housing includes a trough-shaped bottom part made especially as a plastic molding and an essentially flat cover which is likewise made especially as a plastic molding and which closes the bottom part on the open side, that the rotary latch and the detent pawl are located in the lowermost plane on the bottom of the bottom part, that in the lowermost plane of the bottom part, in addition to the rotary latch and the detent pawl, the electrical drive unit is located in the drive housing and that in the second-lowermost plane, preferably supported on the same bearing bolt as the detent pawl, the detent pawl lever and a driven element which is located on the outside of the drive housing, especially in the form of a cam wheel, are located.

8 Claims, 3 Drawing Sheets

U.S. PATENT DOCUMENTS 5,901,991 A * 5/1999 Hugel et al. ..... 292/201
5,934,717 A * 8/1999 Wirths et al. ..... 292/201
6,003,910 A * 12/1999 Dupont et al. ..... 292/201
6,050,117 A * 4/2000 Weyerstall ..... 70/277
6,076,868 A * 6/2000 Roger et al. ..... 292/201
6,109,674 A * 8/2000 Bartel et al. ..... 292/337
6,232,684 B1 * 5/2001 Haag et al. ..... 310/68 R
6,349,983 B1 * 2/2002 Dupont et al. ..... 292/201
6,371,536 B1 * 4/2002 Koerwer et al. ..... 292/201
6,386,599 B1 * 5/2002 Chevalier ..... 292/201
6,390,517 B1 * 5/2002 Ehret ..... 292/201
6,419,286 B1 * 7/2002 Szablewski ..... 292/216
6,422,616 B1 * 7/2002 Wortmann et al. ..... 292/216
6,428,058 B1 * 8/2002 Graute ..... 292/216
6,435,573 B1 * 8/2002 Szablewski ..... 292/201
6,439,623 B1 * 8/2002 Lohfeld et al. ..... 292/201
6,471,259 B1 * 10/2002 Weyerstall et al. ..... 292/201
2001/0010427 A1 * 8/2001 Roos ..... 292/201
2001/0050483 A1 * 12/2001 Hanisch et al. ..... 292/216
2001/0052705 A1 * 12/2001 Fisher ..... 292/216
2002/0074808 A1 * 6/2002 Inoue ..... 292/216

* cited by examiner

MOTOR VEHICLE ELECTRIC DOOR LOCK AND A PROCESS FOR INSTALLING A MOTOR VEHICLE DOOR LOCK MADE AS AN ELECTRIC LOCK

BACKGROUND OF THE INVENTION

1. Technical Filed of the Invention

The present invention relates to a motor vehicle door lock, more particularly to an electric side door lock of a motor vehicle body. Further present invention relates a process for installing a motor vehicle electric door lock.

2. Description of the Prior Art

A motor vehicle door lock in the form of an electric lock has long been known as disclosed in DE 195 45 722 A1.

In accordance with the present invention it should be considered that in terminology a "motor vehicle door lock" is defined particularly as side door locks of motor vehicle bodies, but may also include door locks for rear doors or rear hatches, for sliding doors and hoods, to the extent they are provided with an electric motorized opening aid. The expression motor vehicle door lock or the expression electric lock is used below representatively for the different types of door locks.

Further, in accordance with the present invention the key collar is defined as a wedge-shaped clamp in a narrow sense, but may also include locking clips, locking clips with a transversely lying locking pin and free-standing locking pin, as well as all others types of counterpieces to the door lock on the opposing body component.

An inlet channel for the key collar is made in the housing of the motor vehicle door lock, often also in an additional mounting part which is located in the housing and which is generally called a catch bearing. The inlet channel is completed by the corresponding inlet slots in metal reinforcing plates on the front and/or back of the outside housing; they are often called the first and the second rear sheet.

Rotary latches and detent pawls are typical lock elements of one such motor vehicle door lock, the rotary latch currently being made mostly as a fork latch with a preliminary catch and a main catch. The rotary latch and the detent pawl include ordinary additional parts such as the detent pawl spring and the rotary latch springs, as are of course known from the prior art. Motor vehicle door locks are also known with simply one locking catch, which replaces the rotary latch and the detent pawl, and these motor vehicle door locks also lie within the framework of this invention.

The blocking elements, bearing bolts for the blocking elements and the rear sheets generally consist of metal in order to be able to accommodate and deflect the tearing forces which occur in practice, especially in an accident. The outside housing, other mounting components and the catch bearing of a motor vehicle door lock currently consist mostly of plastic, often fiber-reinforced plastic. To some extent also metal inserts and metal parts are also used.

An electric lock is characterized by a minimum number of installation parts because the sole control function is lifting the detent pawl off the rotary latch. All other functions which are accomplished in mechanical door locks by lever arrangements are replaced in an electric lock by switching functions of the electronic circuit or the software by which the drive motor is triggered or not triggered.

The known electric lock disclosed in DE 195 45 722 A1 shows an outside housing which is essentially closed on all sides and which is made as a plastic molding. It is disclosed there that the outside housing according to one preferred development is made essentially symmetrical to its center plane which lies in or parallel to the plane of the rotary latch and detent pawl and consists of two half shells which are made of plastic, are provided on the outside with metallic reinforcing plates, and are connected to one another. This outside housing is made elongated and plate-like and on the two flat sides parallel to the center plane is provided in the half facing the lengthwise end with an inlet slot, the two inlet slots jointly forming the through inlet channel. The inlet channel with the inlet slots on the two flat sides of the outside housing is the catch bearing of the key collar.

The above explained construction of the known electric lock allows easy installation for both left-hand entry and right-hand entry of the key collar or also for middle entry of the key collar for example on a rear door or rear hatch. The flat and slender contour of the outside housing is also suited for limited installation space.

The above noted electric lock is disclosed on the one hand as a pure electric lock, in which redundancy is achieved by electrical means, for example by an extra battery or other additional power supply as disclosed in EP 0 589 158 A1, but can also be additionally equipped with auxiliary mechanical actuation of the detent pawl via Bowden cables. Reference should be made to these publications for the various possibilities of the configuration of auxiliary mechanical actuation.

In accordance with the present invention there is no auxiliary mechanical actuation; it is intended to be primarily a pure electric lock with optionally electrically implemented redundancy. In any case an auxiliary mechanical actuation accomplished as in the prior art is not entirely precluded, in particular does not contradict the implementation of the present invention.

The above noted motor vehicle door lock underlying the invention must be turned several times in installation. There are no details on the installation of this electric lock in this prior publication.

Furthermore, a motor vehicle door lock which is, made with an outside housing which is not fully closed, but has openings via which moisture can enter is known. This outside housing contains the rotary latch and the detent pawl as well as a plurality of levers of the lock mechanism. The outside housing bears the rotary latch and the detent pawl on one side of a center wall, held there by a rear sheet with, the lever of the lock mechanism on the other side of the center wall. Ultimately the outside housing is reduced to the peripheral edge of a plastic catch bearing.

A plastic housing cover in which the electrical conductors are injected is connected to the peripheral edge of the outside housing in the above noted motor vehicle door lock. The housing cover has a trough-shaped receiver open to the inside for the electrical drive unit which is closed and sealed by a closing plate. In the inside the closing plate bears the electrical drive motor and the step-down gearing. The driven element of the step-down gearing is made as a cam wheel and is located on the opposing side, thus the outside of the closing plate. This cam wheel projects into the lock mechanism at suitable locations as soon as the housing cover has been joined to the edge of the outside housing. The cam wheel is sealed by the closing plate by way of a rotary bushing so that the receiver of the electrical drive unit is extremely well protected against moisture.

The above explained motor vehicle door lock is not an electric lock, but a mechanical motor vehicle door lock provided with an electrical central interlock system. In fact, the electrical drive unit is best sealed against moisture by encapsulation of all components with an electrical function in a plastic housing cover.

In the above explained motor vehicle door lock the parts of the motor vehicle door lock must be repeatedly turned during installation. The outside housing—the plastic catch bearing—is equipped from one side with the locking elements, from the other side the levers of the lock mechanism are attached. Separately therefrom the housing cover is equipped with the pre-installed closing plate/drive unit module from one side. The housing cover is then connected in the opposite direction to the outside housing. In installation therefore repeated handling of the different parts of the motor vehicle door lock is necessary.

SUMMARY OF THE INVENTION

A object of the present invention is to optimize the known electric lock while maintaining the three-dimensionally effective configuration of the outside housing with respect to installation.

The aforementioned object is achieved by an electric lock where installation from one side is also possible, therefore rotation of the workpiece during installation is not necessary.

The teaching of the invention can also be used when the electric lock is supposed be provided with auxiliary mechanical actuation. It can also be integrated into the invention in terms of the installation direction.

The invention is detailed below using drawings which show only one embodiment.

DETAILED DESCRIPTION OF THE INVENTION

Figure 1:
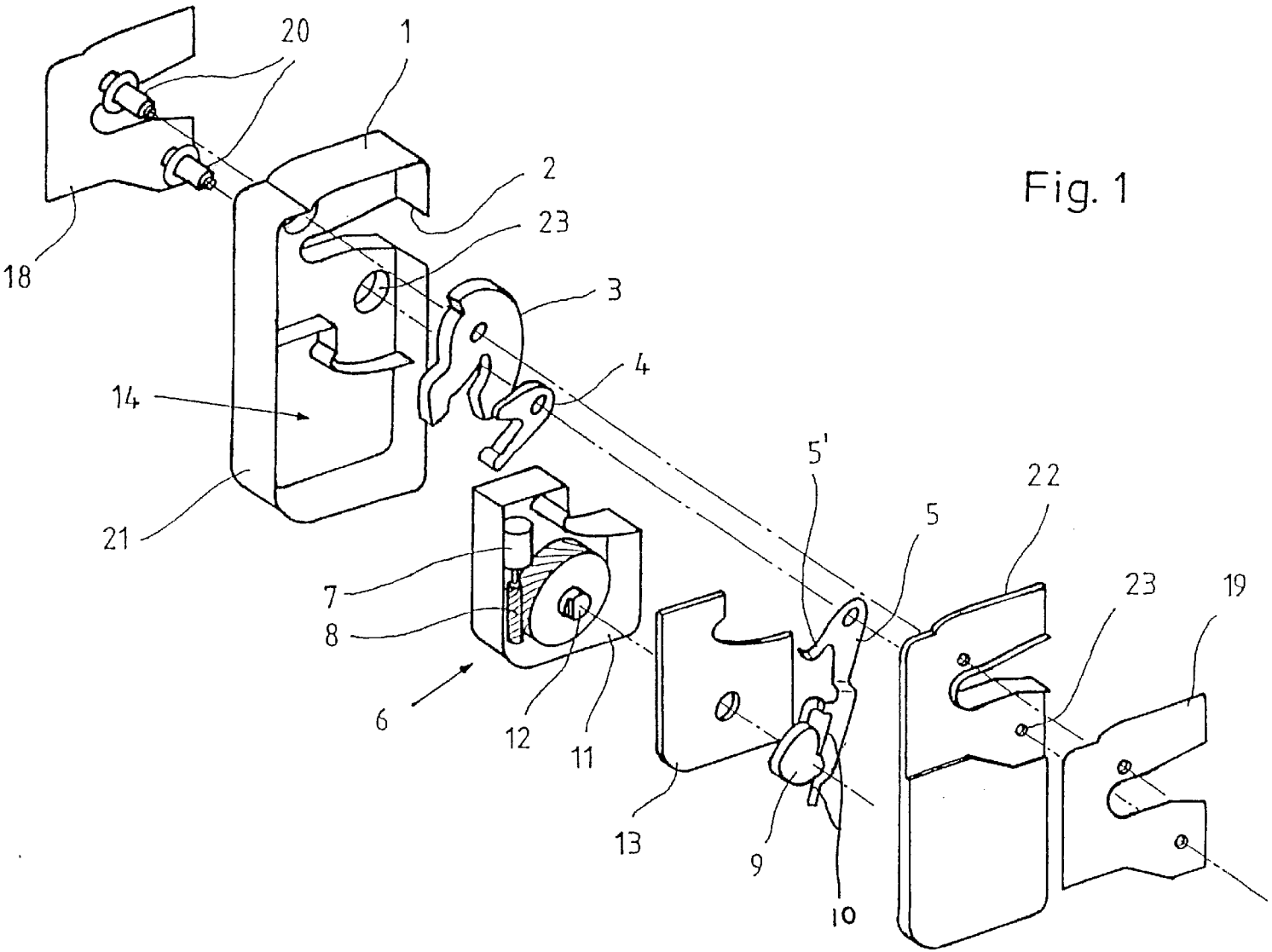
FIG. 1 shows in a type of exploded view the structure of one especially preferred embodiment of a motor vehicle door lock in accordance with the present invention which is made as an electric lock, at the same time showing the installation sequence according to the preferred embodiment.

Initially, reference should be made to the introductory part of the description for the explanation of the various terms. The term electric lock is also used below for the motor vehicle door lock in accordance with the present invention. Furthermore, for comprehensive disclosure of a plurality of construction versions for an electric lock, reference should be made to DE 195 45 722 A1 which forms the starting point for the teaching, and the contents of which are also made expressly the disclosure content of this invention.

The exploded view from FIG. 1 clearly shows all the features explained below in conjunction with the somewhat enlarged representation in FIG. 2 and in FIG. 3 using the preferred embodiment shown here.

The illustrated electric lock first of all has an outside housing 1 which is essentially closed on all sides and which, as is already known in the prior art, is made as a plastic molding and also as one part of the catch bearing for the key collar which is not shown here, and is used to hold a corresponding key collar buffer.

The outside housing 1 has an inlet channel 2 for the key collar, which, as stated, is not shown, and which is located on the opposite part of the motor vehicle body. In the outside housing 1 of the electric lock there are only the locking elements, specifically the rotary latch 3 and the detent pawl 4 which holds the rotary latch 3 in the closed position, especially in a preliminary catch and in a main catch, a separate detent pawl lever 5 which is dynamically connected to the detent pawl 4 or which is made on the detent pawl 4 as an extension, and an electrical opening drive unit 6 with a drive motor 7, step-down gearing 8, and a driven element 9. Other important small parts such as the detent pawl springs, rotary latch springs or combined tension springs, leg springs for pretensioning of the detent pawl lever 5, microswitches or Hall sensors, printed conductors or circuit board, etc. are not shown.

The driven element 9 via the detent pawl lever 5 drives the detent pawl 4 in the lifting direction and engages the actuating section 10 of the detent pawl lever 5 in doing so.

The drive unit 6 is located in a drive housing 11 which is located in the outside housing 1 and which is sealed relative to the remainder of the outside housing 1, the driven element 9 of the drive unit 6 is a cam wheel 9 which is located on the outside of the drive housing 11 and the drive shaft 12 of the cam wheel 9 sealed by means of a rotary bushing is routed through the cover 13 of the drive housing 11. FIG. 2 shows the cam wheel 9, FIG. 1 shows the rotary bushing of the drive shaft 12. The electrical drive unit 6 in this embodiment is made as a worm gear drive. For the configuration of the cam wheel 9 the explanations in the general part of the specification apply which refer to the versions known in the prior art with one or two journal-shaped cams or a crank or even several cranks.

Figure 2:
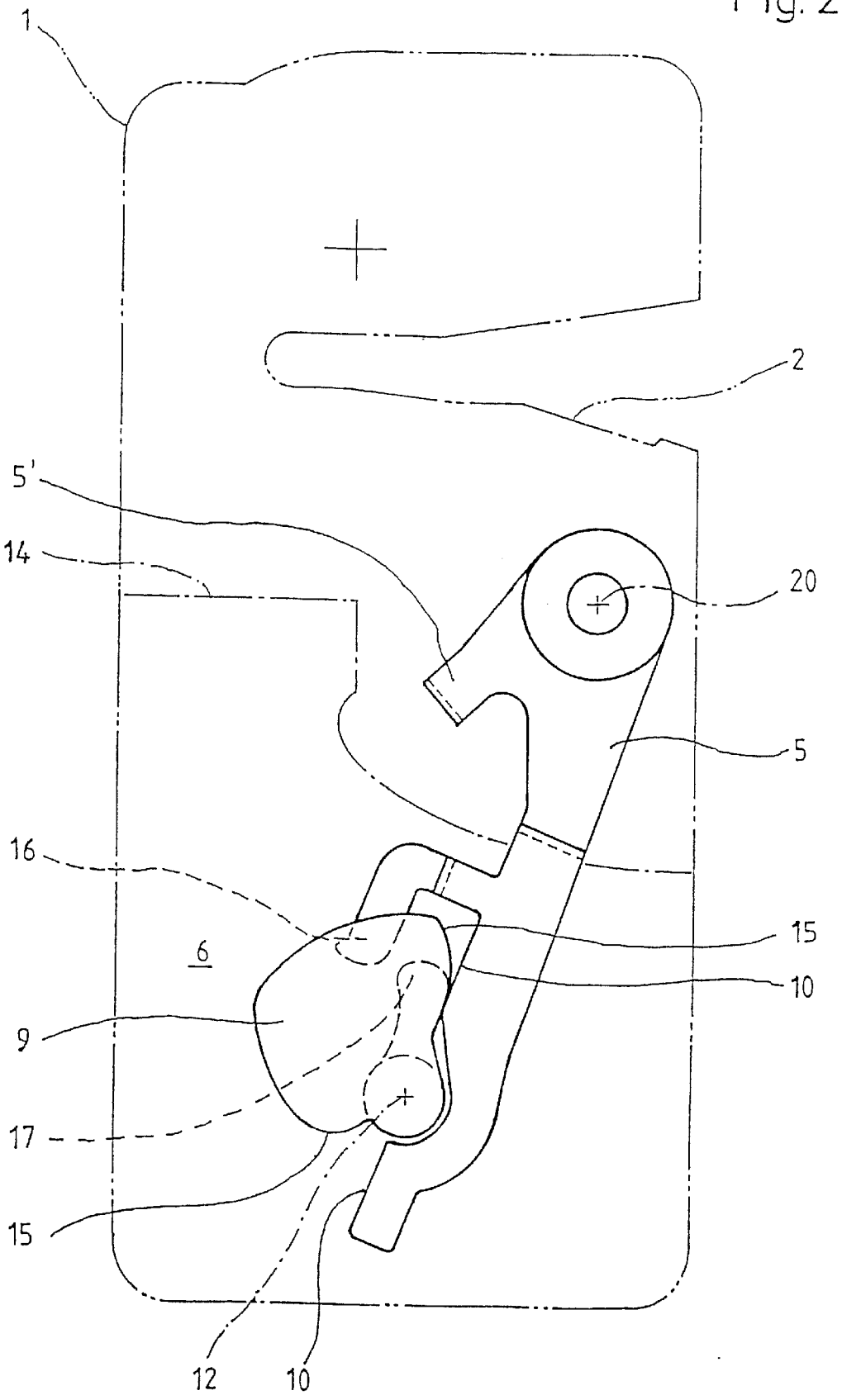
FIG. 2 is a schematic view of the bottom of the outside housing of the electric lock of FIG. 1, having the cover thereof removed.

The depicted embodiment shows both in FIG. 2 and FIG. 1 that the outside housing 1 is made elongated and like a flat plate. Here it is provided that the inlet channel 2 with the rotary latch 3 and the detent pawl 4 is located roughly in the half of the outside housing 1 near the lengthwise end and the drive unit 6 is located roughly in the half of the outside housing 1 near the other lengthwise end, and the detent pawl lever 5 extends from the one half into the other. This slender and flat, plate-like construction of the electric lock allows installation even under constricted space conditions and thus represents an especially feasible embodiment of the electric lock.

Furthermore, it is provided here that the inlet channel 2 is open toward the two flat sides of the outside housing 1. Accordingly, the electric lock of the present invention allows for installation in the motor vehicle body independently of the side. Finally, it is provided here that the inlet channel 2 is made as a catch bearing or as part of the catch bearing for the key collar.

The preferred embodiment illustrates in FIG. 1 in conjunction with FIG. 2 that the cam wheel 9 is located on the outside of the wall of the drive housing 11 parallel to the plane defined by the rotary latch 3 and the detent pawl 4. In this way the rotation of the cam wheel 9 takes place in a plane parallel to the motion of the locking elements. This in turn makes it possible to have the detent pawl lever 5 supported and actuated axially parallel to the detent pawl 4. This is an especially simple construction which has proven very effective in practice and in this case contributes to optimum use of space within the outside housing 1. The embodiment shown illustrates that according to one preferred teaching the wall is formed by the cover 13 which is placed on the trough-shaped bottom part of the drive housing 11 to form a seal.

To form the drive housing 11 there are two different possibilities. While not shown, the trough-shaped bottom part of the drive housing 11 may be formed integrally in the outside housing 1 and is closed with a separate cover 13 to form a seal. In this version the drive housing 11 is assembled in the outside housing 1; the outside housing 1 forms the drive housing 11 essentially in a sealed "compartment".

As illustrated, the drive housing 11 is made separate, especially with a trough-shaped bottom part and a cover 13 which is seated to form a seal, and is inserted into the outside housing 1, preferably into the receiver 14 of the outside housing 1. FIG. 1 shows the receiver 14 formed by a crosspiece in the outside housing 1, this crosspiece being used at the same time for positioning and fixing the drive housing 11 within the outside housing 1. Accordingly, the electric drive unit 6 can be assembled beforehand as a module and then inserted easily into the outside housing 1 with the drive housing 11 closed.

Part of the electrical drive unit 6 should also be the control electronics which is made or located likewise protected within the drive housing 11. The contact-making possibilities with the circuit board, etc. are discussed hereinabove.

Figure 3:
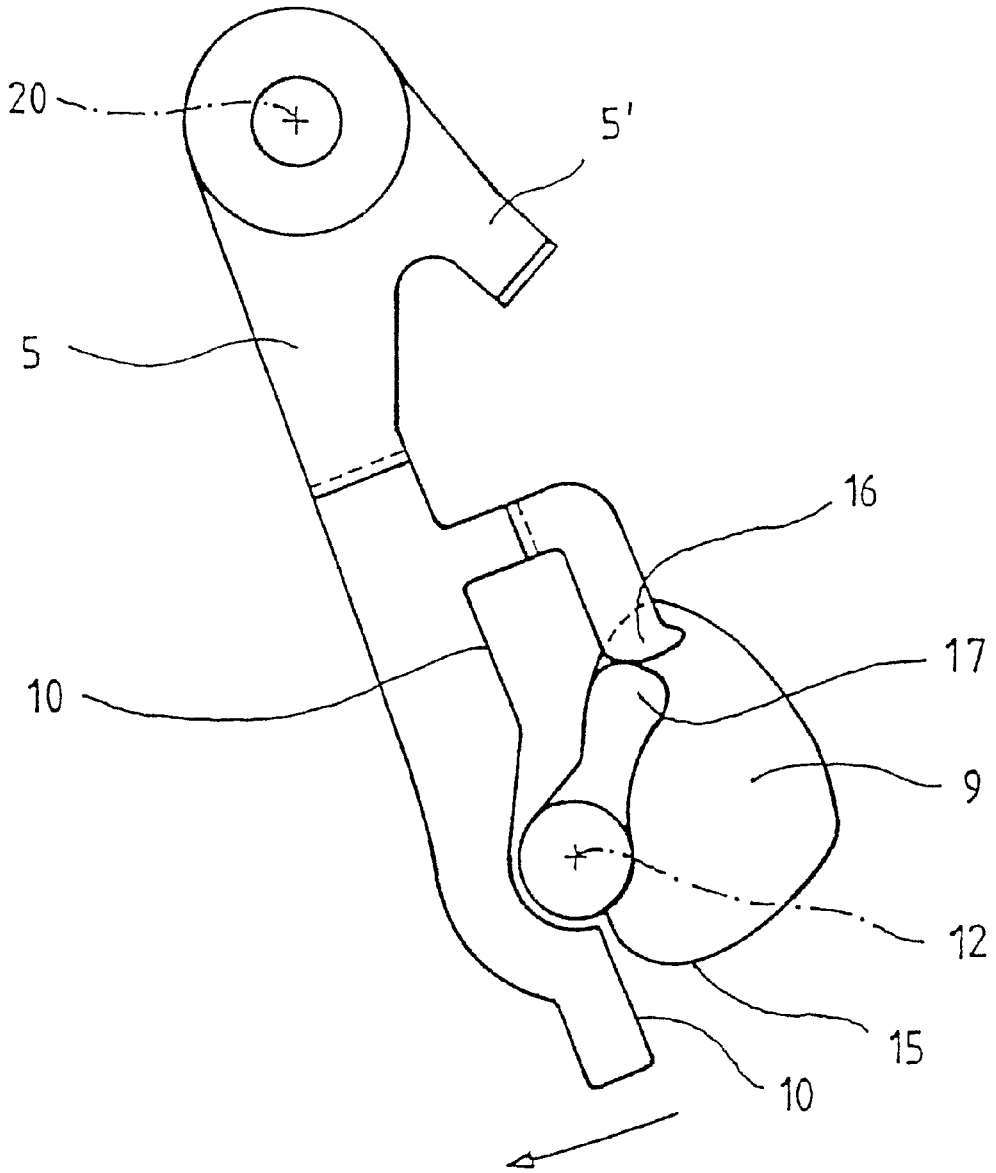
FIG. 3 illustrates the cam wheel and the detent pawl lever of the electric lock extracted from FIG. 1.

FIGS. 2 and 3 show particulars of the mechanical power transfer from the cam wheel 9 to the detent pawl lever 5. The embodiment shown illustrates the separate detent pawl lever 5 so that the detent pawl 4 can remain lifted, even if the detent pawl lever 5 has already returned again to the closed position shown in FIG. 2.

As illustrated in FIGS. 2 and 3 the cam wheel 9 has an eccentrically arranged, arc-shaped crank 15 which engages the actuating section 10 of the detent pawl lever 5.

The arc-shaped crank 15 can be shaped in its outside contour which engages the actuating section 10 such that a certain motion characteristic of the detent pawl lever 5 with certain moments arises. As noted hereinabove, there are a plurality of stimuli for cam contours in the prior art.

While not specifically illustrated, the drive unit 6 may actuate the detent pawl lever 5 in only one direction of rotation and preferably the cam wheel 9 in interaction with the actuating section 10 accomplishes a degressive starting characteristic. The concept of degressive starting characteristic means that when the starting motion begins, a high moment is applied and is reduced according to the contour of the crank 15 as the rotary motion of the cam wheel 9 continues, to the benefit of low stepping down and thus increased opening speed.

The preferred embodiment shown illustrates one alternative wherein the drive unit 6 actuates the detent pawl lever 5 in both directions of rotation and the cam wheel 9 in one direction of rotation with a low step-down ratio acts on the detent pawl 4, in the other direction of rotation on the other hand on the detent pawl 4 with a larger step-down ratio. In FIG. 2 the direction of rotation of the cam wheel 9 clockwise is the direction of rotation which is first in this sense with a low step-down ratio, but higher speed, the direction of rotation of the cam wheel 9 counterclockwise corresponds to the second direction of rotation with the higher step-down ratio and lower speed. In terms of control engineering of course the torque of the electric drive motor 7 or another characteristic quantity must be acquired in order to establish that it is necessary to switch from one operating mode to the other, for example when an especially high door counterpressure has been set (for example, after an accident). The concept implemented here makes it possible to achieve different speeds and moments with unchanged triggering of the electric drive motor 7, therefore abandoning phase angle control or pulse width modulation.

Otherwise, in terms of circuitry many of the possibilities known from the prior art can be used, especially the rotary latch, detent pawl and/or worm gear of the step-down gearing 8 can be provided with magnets which actuate suitably arranged Hall switches. The drive unit 6 can additionally be equipped via mechanical stops for the step-down gearing 8 for respective calibration when the positioning drifts, as is likewise known from the prior art.

FIGS. 2 and 3 further show one particular feature of the electric lock that is the drive unit 6 is designed to be self-locking, that on the especially separate detent pawl lever 5 in the actuation section 10 a shaped blocking piece 16 is formed and that when the driven element 9 is in the rest position and when the detent pawl lever 5 is in the closed position the driven element 9 is in front of the shaped blocking piece 16 of the detent pawl lever 5 such that the detent pawl lever 5 cannot swivel in a raising direction (FIG. 3).

To not swivel in the raising direction means in this embodiment in the implementation of a detent pawl lever 5 which is separate from the detent pawl 4, not the blocking of the detent pawl 4, but the blocking of the detent pawl lever 5 such that it cannot be unintentionally swivelled in the raising direction upon a side impact with the action of a force in the swivelling plane of the detent pawl lever 5. FIG. 3 shows the raising direction by the arrow. Motion in this direction is prevented by the shaped blocking piece 16.

In a detent pawl lever 5 made on the detent pawl 4 integrally as an elongated arm, blocking of course also results in that the detent pawl 4 cannot be mechanically pressed up from the entry channel 2 (additional antitheft feature).

The embodiment shown illustrates that the driven element is a cam wheel 9 which has at least one journal or a crank 15 as not shown. At this point it can be provided that the journal, another journal, or especially the existing crank 15 interacts with the shaped blocking piece 16 on the detent pawl lever 5.

The preferred embodiment shown however illustrates one version in which the crank 15 in both directions of rotation interacts with the actuating section 10 of the detent pawl lever 5. Consequently it is provided here in an especially suitable manner that the other flat side of the cam wheel 9 is used for the blocking function. To do this a blocking projection 17 is formed the surface of the cam wheel 9 opposite the crank 15 and the shaped blocking piece 16 of the detent pawl lever 5 extends to the opposite surface of the cam wheel 9 and interacts there with the blocking projection 17. The offset of the plane of the shaped blocking piece 16 relative to the actuating section of the detent pawl lever 5 on the bend of the angle arm which forms the shaped blocking piece 16 in FIG. 3 is clear.

Finally, the embodiment shown illustrates that the detent pawl lever 5 is pivotally mounted on the swivelling axis of the detent pawl 4 or the swivelling axis parallel to it. Support on the swivelling axis of the detent pawl 4 which is accomplished here leads to the detent pawl lever 5 with a driver arm 5's extending into another plane, specifically the plane of the detent pawl 4, or the detent pawl 4 with a corresponding arm or journal extending into the plane of the detent pawl lever 5. This is shown in FIG. 3. The support on the axis of the detent pawl 4 is kinematically suitable and uses the bearing bolt twice.

This embodiment moreover shows the supporting detent pawl 4 which blocks the rotary latch 3 and which is compressively stressed. The corresponding detent pawls which are tensile stressed, are made as a hook which extends over the rotary latch 3, can of course likewise be used in a corresponding modification of the detent pawl lever 5.

This preferred embodiment shows in FIG. 1 that the outside housing 1 on one flat side, and preferably on both flat sides, is provided with a metallic reinforcing plate 18, 19 or one each, that the metallic reinforcing plates 18, 19 are securely joined to one another, especially braced, with the interposition of the outside housing 1, and that the connection of the metallic reinforcing plates 18, 19 takes place via metallic bearing bolts 20 for the rotary latch 3 and the detent pawl 4.

Otherwise the outside housing 1 is held of course closed via other means, for example via catch clips, screws or a locking peripheral edge.

This preferred embodiment can implement all possibilities known in the prior art for contact-making of the drive motor 7 of the drive unit 6. According to one preferred teaching it can furthermore be provided that the electric drive motor 7 of the drive unit 6 makes contact directly on a circuit board or the like and on the contacts of the electrical drive motor 7 has flexible contact strips which are securely attached and which are soldered to the contact surfaces of the circuit board or the like.

The electric lock of the present in the invention is further advantageous due to its ease of installation. In fact it is possible, as FIG. 1 shows, to assemble the electric lock exclusively from one side so that rotation of the workpiece during installation is not necessary. This is a great simplification which has been rendered possible in construction terms by various measures.

This embodiment shows first of all that the outside housing 1 consists of a trough-shaped bottom 21 part made as a plastic molding and an essentially flat cover 22 which is likewise made as a plastic molding and which closes the bottom part 21 on the open side, that in the lowermost plane on the bottom of the bottom part 21 the rotary latch 3 and the detent pawl 4 are located, that in the lowermost plane of the bottom part 21, in addition to the rotary latch 3 and the detent pawl 4, the electrical drive unit 6 is located in the drive housing 11 and that in the second-lowermost plane, preferably supported on the same bearing bolt 20 as the detent pawl 4, the detent pawl lever 5 and a driven element 9 which is located on the outside of the drive housing 11, especially in the form of a cam wheel, are located.

It is furthermore provided that underneath the base of the bottom part 21 of the outside housing 1 there is a metal reinforcing plate 18, that bearing bolts 20 are securely attached to the metal reinforcing plate 18 and penetrate the through openings 23 in the bottom 21 and in the cover 22 and that above the cover 22 there is another metal reinforcing plate 19 and the bearing bolts 20 are connected here to the second metal reinforcing plate 19. With this construction there is a sandwich-like arrangement of the outside housing 1 between the metal reinforcing plates 18, 19 so that an installation capacity of the electric lock is independent of the side results. This construction makes it possible to undertake installation solely from one direction, especially beginning with the fact that the first reinforcing plate 19 is equipped from the start with bearing bolts 20 for the rotary latch 3 and the detent pawl 4 and is used to a certain extent as the "base plate" in the installation of the entire electric lock.

FIG. 1 also shows accordingly in this exploded view the process for installation of this electric lock which includes the following process steps:

a) A first metal reinforcing plate 18 with bearing bolts 20 securely attached thereto for the rotary latch 3 and the detent pawl 4 with the bearing bolts 20 pointing upward is positioned on a base.

b) The trough-shaped bottom 21 of the outside housing 1 made of a plastic molding is slipped onto the bearing bolts 20 by way of through openings 23 and pressed down as far as the reinforcing plate 18.

c) In the area of the inlet 2 the rotary latch 3 and the detent pawl 4 are inserted into the bottom part 21 and slipped onto the bearing bolts 20 with the bearing openings.

d) In addition to the rotary latch 3 and the detent pawl 4 a prefabricated drive housing 11 is inserted into the bottom 21 and attached so that a driven element 9, in the form of a cam wheel, rests on the top of the drive housing 11.

e) The detent pawl lever 5 is slipped onto the bearing axle, onto the bearing bolt of the detent pawl 4, and positioned such that it engages in operation the detent pawl 4 and the driven element 9.

f) A cover 22 which completes the inlet channel 2 and which closes the bottom 21 of the outside housing 1 is seated on the bearing bolts 20 and is joined to the bottom 21.

g) A second metal reinforcing plate 19 is pressed onto the cover 22 and by way of the corresponding through openings onto the end of the bearing bolts 20 which project out of the cover 22.

h) The ends of the bearing bolts 20 are securely connected to the second metal reinforcing plate 19, by pressing or other means.

FIG. 1 shows for better recognition of the drive unit 6 the cover 13 of the drive housing 11 removed, although in the installation process described hereinabove the drive unit 6 is used as a modular unit.

In a modified process, when the drive unit 6 is fabricated on the assembly line it can be provided that instead of the process step d) the process steps are the following:

$d_1$) In addition to the rotary latch 3 and the detent pawl 4, the trough-shaped bottom part of the drive housing 11 which is open to the top and which is made especially as a plastic molding is inserted into the bottom part 21 of the outside housing, $d_2$) The electric drive motor 7 and step-down gearing 8 as well as other conventional parts are inserted into the bottom part of the drive housing 11, $d_3$) The bottom part of the drive housing 1 is closed by means of a cover 13 which penetrates from the drive shaft 12 of the step-down gearing 8 in the rotary bushing, $d_4$) A driven element 9, particularly a cam wheel, is positioned on the projecting end of the drive shaft 12 and fixed thereto.

In another modified process, for an integrated drive housing 11 it can be provided that instead of the process step d) the following process steps d) are carried out:

$d_{1'}$) The components of the drive unit 6, therefore the drive motor 7 and the step-down gearing 8, are inserted into the trough-shaped bottom part of the drive housing 11, which bottom part is formed integrally in the outside housing 1.

$d_{2'}$) The bottom part is sealed shut with a cover 13 which has a rotary bushing for the drive shaft 12 of the drive unit 6, the drive shaft 12 being routed out sealed.

$d_{3'}$) A driven element 9, particularly a cam wheel, is positioned on the projecting end of the drive shaft 12 and fixed thereto.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention by limited only by the appended claims.

What is claimed is:

1. A motor vehicle electric door lock comprising:

an outside housing close on all sides and which is made as a plastic molding, with an inlet channel for the k y collar and with, located in the outside housing, a rotary latch, a detent pawl which holds the rotary latch, a separate detent pawl lever which is dynamically connected to the detent pawl or which is made on the detent pawl as an extension, and an electrical opening drive unit with a drive motor, a step-down gearing, and a driven element, the driven element via the detent pawl lever driving the detent pawl in a lifting direction and engaging an actuating section of the detent pawl lever, wherein the outside housing is elongated and has two flat sides and comprising a trough-shaped bottom part made as a plastic molding with one large open side and an essentially flat cover made as a plastic molding and which closes the trough-shaped bottom part n the open side, and wherein the rotary latch and the detent pawl are located in a lowermost plane on a bottom of the trough-shaped bottom part of the outside housing, the electrical drive unit is located in a drive housing in the lower most plane on the bottom of the trough-shaped bottom part of the outside housing, and the detent pawl lever is located in a second-lowermost plane relative to the bottom of the trough-shaped bottom part of the outside housing an the driven element of the drive unit is located on the outside of a drive housing in the second-lowermost plane relative to the bottom it of the trough-shaped bottom part of the outside housing.

2. The electric lock as claimed in claim 1, wherein a metal reinforcing plate is positioned underneath the bottom of the trough-shaped bottom part of the outside housing, and bearing bolts are securely attached to the metal reinforcing plate and penetrate through openings in the bottom part and in the cover and above is positioned another metal reinforcing plate and the bearing bolts are connected to the second metal reinforcing plate.

3. The electric lock as claimed in claim 1, wherein the inlet channel with the rotary latch and the detent pawl is located substantially in a first half of the outside housing ear one lengthwise end and the drive unit is located substantially in a second half of the outside housing near another lengthwise end, and the detent pawl lever extends from the first half into the second half.

4. The electric lock as claimed in claim 1, wherein the detent pawl lever having an actuating element extends into a plane of the detent pawl, or the detent pawl which includes a driver element extends into a plane of the detent pawl lever.

5. The electric lock as claimed in claim 1, wherein the inlet channel is open towards the two flat sides of the outside housing.

6. The electric lock as claimed in claim 5, wherein the inlet channel is in the form of a catch bearing or as part of the catch bearing for the key collar.

7. The electric lock as claimed in claim 1, wherein the detent pawl is supported on a bearing bolt and the detent pawl lever is supported on the bearing bolt which supports the detent bawl.

8. The electric lock as claimed in claim 1, wherein the driven element of the drive unit is a cam wheel located on the outside of the drive housing.

* * * * *